US006966554B2

(12) United States Patent
Panini et al.

(10) Patent No.: US 6,966,554 B2
(45) Date of Patent: Nov. 22, 2005

(54) APPARATUS FOR SCANNING BANK CHECKS, WITH AN IMPROVED CHECK FEED DEVICE

(75) Inventors: Ugo Panini, Turin (IT); Pierpaolo Bubbio, Turin (IT)

(73) Assignee: Panini S.p.A., Turin (IT)

( * ) Notice: Subject to any disclaimer, the term of this patent is extended or adjusted under 35 U.S.C. 154(b) by 26 days.

(21) Appl. No.: 10/788,250

(22) Filed: Feb. 26, 2004

(65) Prior Publication Data

US 2004/0251588 A1 Dec. 16, 2004

(30) Foreign Application Priority Data

Feb. 27, 2003 (IT) ..... TO20030033 U

(51) Int. Cl.[7] ..... B65H 3/44; B65H 5/26

(52) U.S. Cl. ..... 271/9.09; 271/220

(58) Field of Search ..... 271/9.09, 220, 271/127, 160; 221/279

(56) References Cited

U.S. PATENT DOCUMENTS 4,429,863 A * 2/1984 Itoh et al. ..... 271/9.09
4,871,160 A * 10/1989 Yoshino ..... 271/9.02
4,896,871 A * 1/1990 Idenawa ..... 271/9.09
6,598,870 B2 * 7/2003 Hanano ..... 271/138

* cited by examiner

*Primary Examiner*—Donald R. Walsh
*Assistant Examiner*—Kenneth W. Bower
(74) *Attorney, Agent, or Firm*—Seed IP Law Group PLLC

(57) ABSTRACT

The scanner apparatus has a feed device for picking up checks from an input receptacle and transferring them to a conveyor mechanism which conveys the checks through the interior of the apparatus. A feed plate resiliently urges a bundle of checks in the receptacle towards an opposed surface. A feed roller acting on the side remote from the plate picks up from the receptacle a check disposed adjacent the surface and transfers it towards the interior of the apparatus. The movement of the feed plate towards the opposed surface is stopped in a position close to that surface so as to define between the plate and the surface a gap of sufficient width for the insertion of at least one check in the input receptacle.

8 Claims, 8 Drawing Sheets

APPARATUS FOR SCANNING BANK CHECKS, WITH AN IMPROVED CHECK FEED DEVICE

BACKGROUND OF THE INVENTION

1. Field of the Invention

The present invention relates to a scanner apparatus for scanning bank checks, with an improved check feed device.

2. Description of the Related Art

As is known, apparatus for scanning checks comprises a conveyor mechanism for conveying the checks, one at a time, from an input receptacle to an output receptacle, passing in front of an image-scanner unit for scanning one or both faces of the check.

Currently, a user uses two different types of scanning apparatus for scanning bank checks, a first type for scanning individual checks which are introduced into the input receptacle one at a time, and a second type for scanning bundles of checks. In this second type of apparatus, a bundle of checks is introduced into an input receptacle between a feed plate and a motor-driven feed roller against which the feed plate is urged resiliently and which picks up one check at a time from the input receptacle and conveys it towards the interior of the apparatus. In order to introduce the bundle of checks between the feed plate and the pick-up roller, it is necessary to move the plate manually away from the pick-up roller, acting against the force of a resilient element which urges the plate against the roller.

BRIEF SUMMARY OF THE INVENTION

The object of the present invention is to provide a scanning apparatus which has a feed device that can control the feeding-in both of checks that are introduced into the input receptacle individually or in small groups, and of bundles of stacked checks.

This and other objects and advantages which will be explained further below are achieved according to the present invention by a scanner apparatus having the characteristics defined in the appended claims.

BRIEF DESCRIPTION OF THE SEVERAL VIEWS OF THE DRAWINGS

Some preferred but non-limiting embodiments of the invention will now be described with reference to the appended drawings, in which.

DETAILED DESCRIPTION OF THE INVENTION

Figure 1:
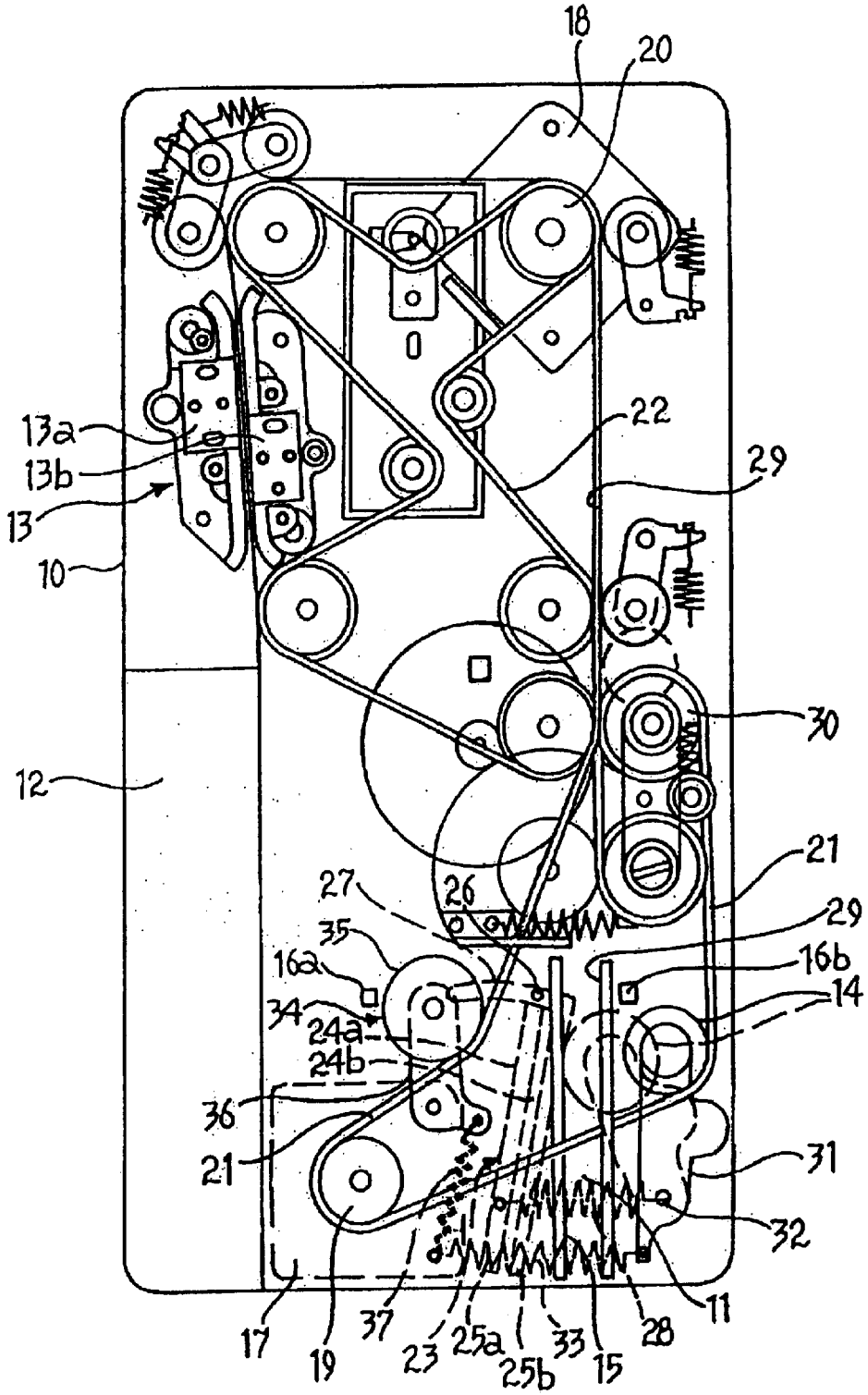
FIG. 1 is a plan view of an apparatus for scanning checks comprising a first embodiment of the feed device according to the present invention.

With reference initially to FIG. 1, an apparatus for scanning checks comprises a body 10 which forms an input receptacle 11 in which one or more checks or a bundle of checks to be scanned can be arranged vertically (by the procedures described below). Inside the body 10 there is a conveyor mechanism of per se known type for conveying the checks, one at a time, from the input receptacle 11 to an output receptacle 12, following a substantially U-shaped path and passing in front of an image-scanner device 13 for scanning one or both faces of the check.

The constructional and functional characteristics of the conveyor mechanism and of the scanner device 13 (which may be of any known type) are not relevant per se for the purposes of an understanding of the invention and are therefore not described in detail herein. Extremely briefly, the checks are picked up from the input receptacle 11 by a feed device described in detail below and comprising a feed roller 14 which cooperates with a feed plate 15. A photocell 16*a*, 16*b* detects the presence of a check in the input receptacle and activates two stepping electric motors 17, 18 which set two respective transmission belts 21, 22 in circulation by means of motor-driven rollers 19, 20; the belts 21, 22 cause one check at a time to move forwards, following a path which extends between a pair of image-scanner units 13*a*, 13*b* each provided with a respective CIS (compact image sensor) optical sensor in order to scan both faces (front and rear) of the check. An electronic control unit (not shown) supervises the operation of the apparatus as a whole and hence also the coordinated operation of all of the above-mentioned drive/actuator members and optical/electronic devices.

Figure 2:
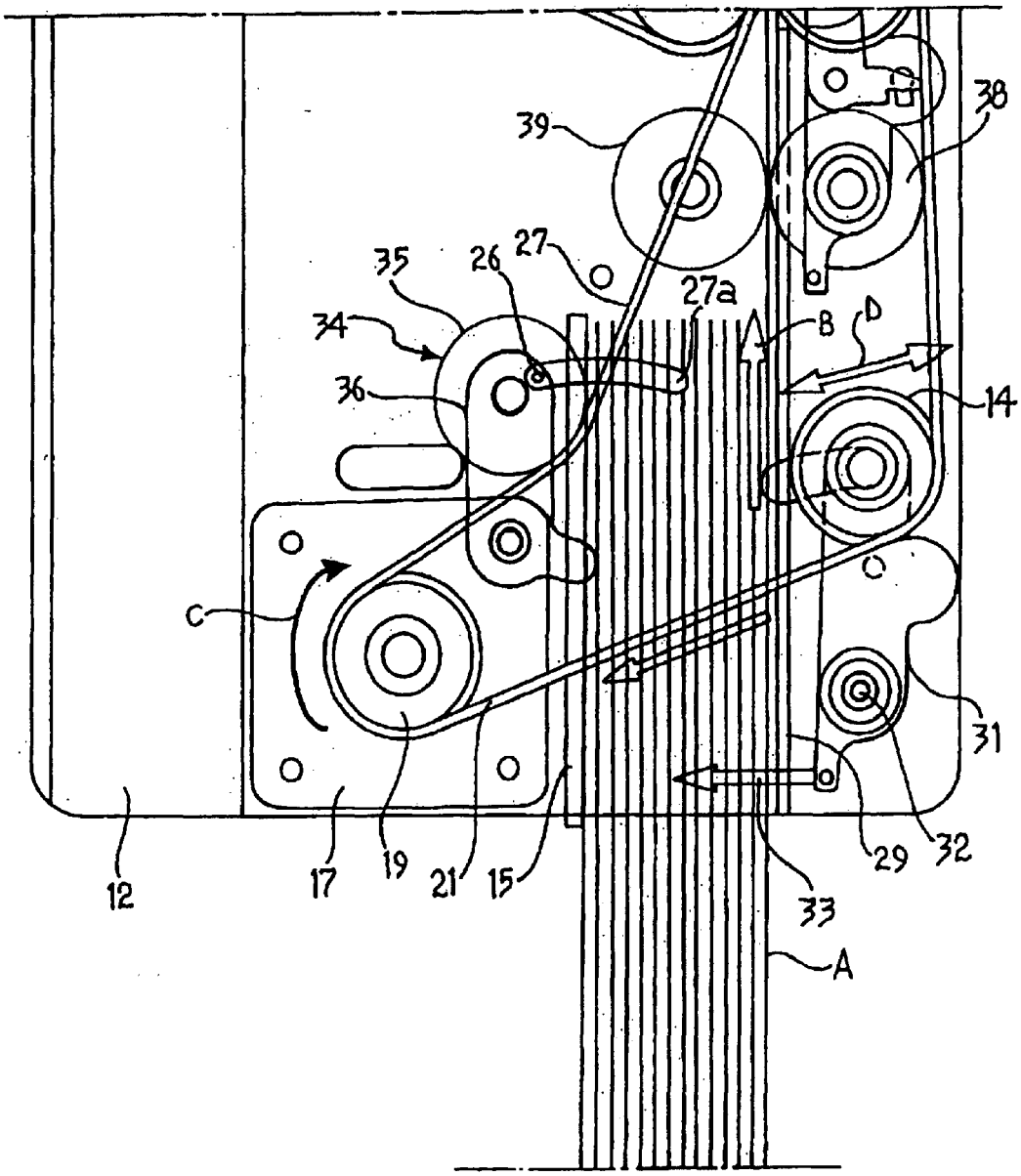
FIG. 2 is a plan view showing the feed device of FIG. 1 on an enlarged scale with a bundle of checks to be scanned.

The feed device is shown in greater detail in FIG. 2. The feed plate 15 is mounted on a parallelogram-type translation mechanism 23 (FIG. 1) housed in the lower portion of the casing. The translation mechanism 23 comprises a pair of parallel levers 24*a*, 24*b* (FIG. 1) which are articulated to the casing at first ends 25*a*, 25*b* (FIG. 1) and are articulated to one another at their opposite ends by a connecting bar (not shown). The lever 24*a* carries a pin 26 which is engaged for sliding in an arcuate slot 27 formed in the casing 10 or in an element fixed thereto. A biasing spring 28 (FIG. 1) urges the mechanism 23 with the feed plate 15 towards an opposed guide surface 29 disposed on the same side as the pick-up and feed roller 14, and thus brings about translation of the plate towards that roller.

The transmission belt 21 circulates around the motor-driven roller 19, a transmission roller 30 disposed further downstream (in the direction of movement of the checks, indicated by the arrow B in FIG. 2), and around the feed roller 14. The roller 14 is mounted on a lever 31 which is articulated to the body of the apparatus at 32 and is acted on by a biasing spring 33 which tends to bring the lever to the rest position shown in solid outline in FIG. 1, in which the roller 14 is moved away from the feed plate 15 and from the input receptacle 11 (FIG. 1). A belt-tensioner device 34 associated with the belt 21 has an idle roller 35 mounted on a pivotable lever 36 which is acted on by a spring 37 (FIG. 1).

Figure 3:
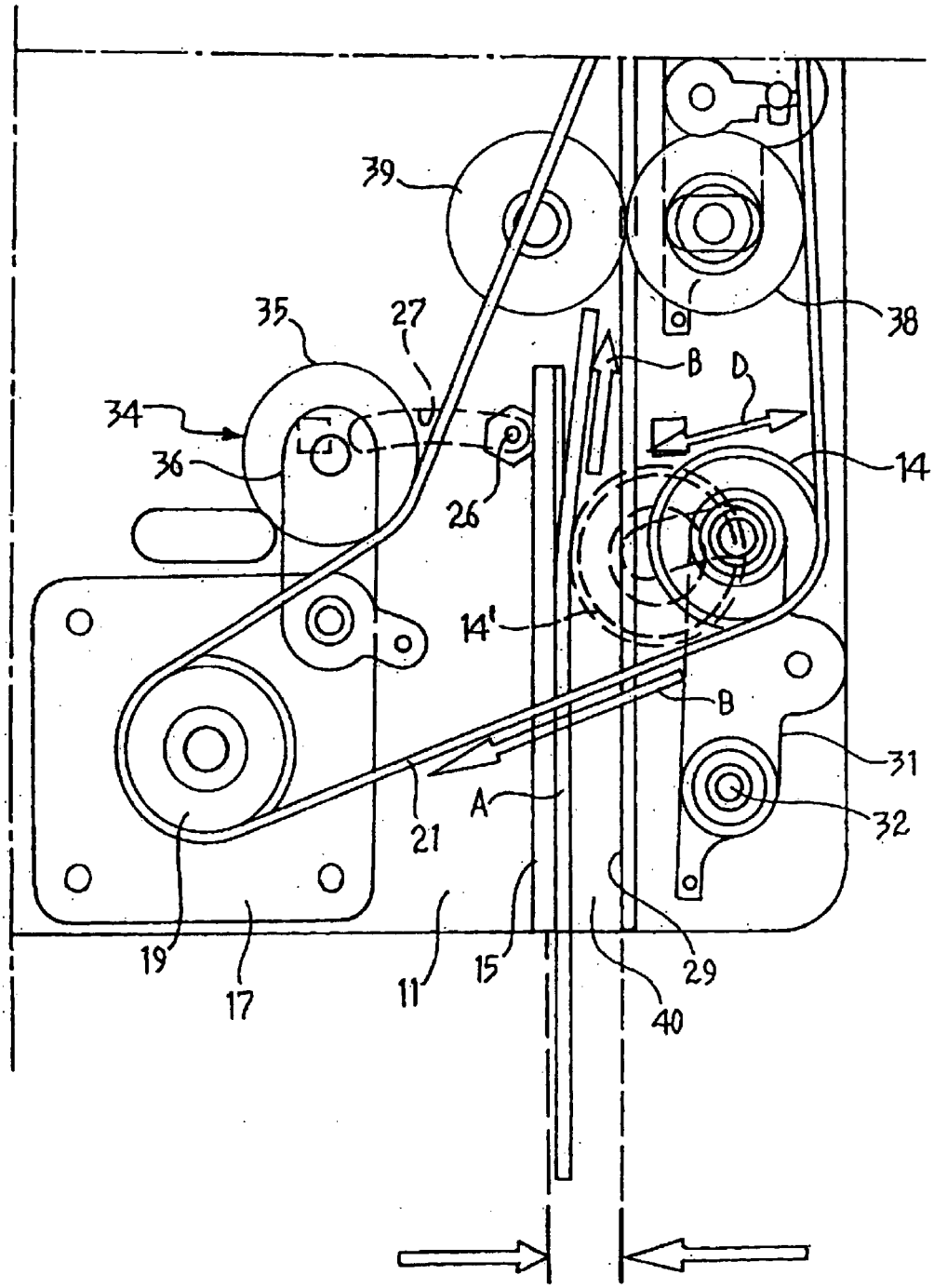
FIG. 3 is a plan view of the feed device of FIG. 2 with a single check to be scanned.
Figure 4:
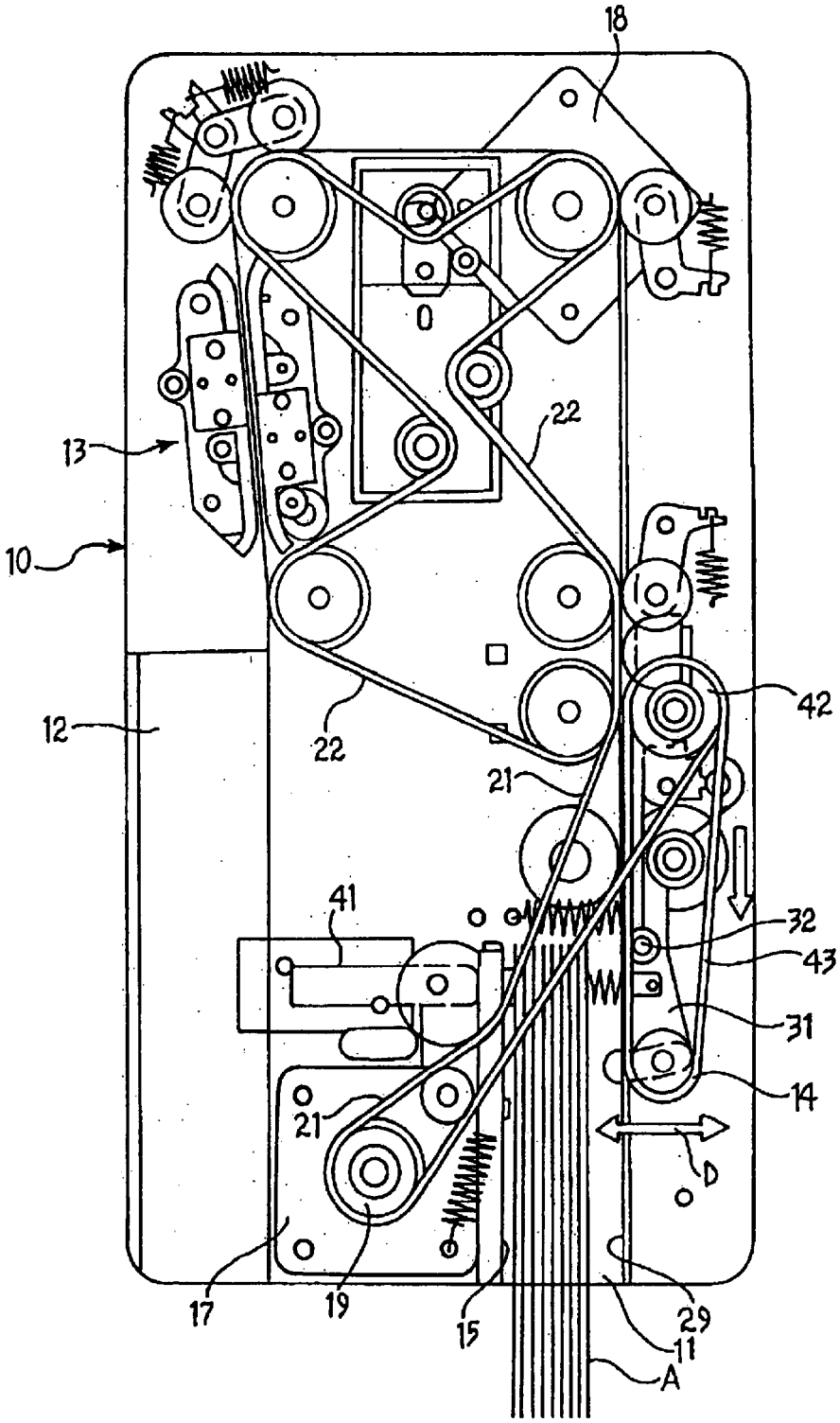
FIG. 4 is a plan view of an apparatus for scanning checks comprising a second embodiment of the feed device according to the invention.
Figure 5:
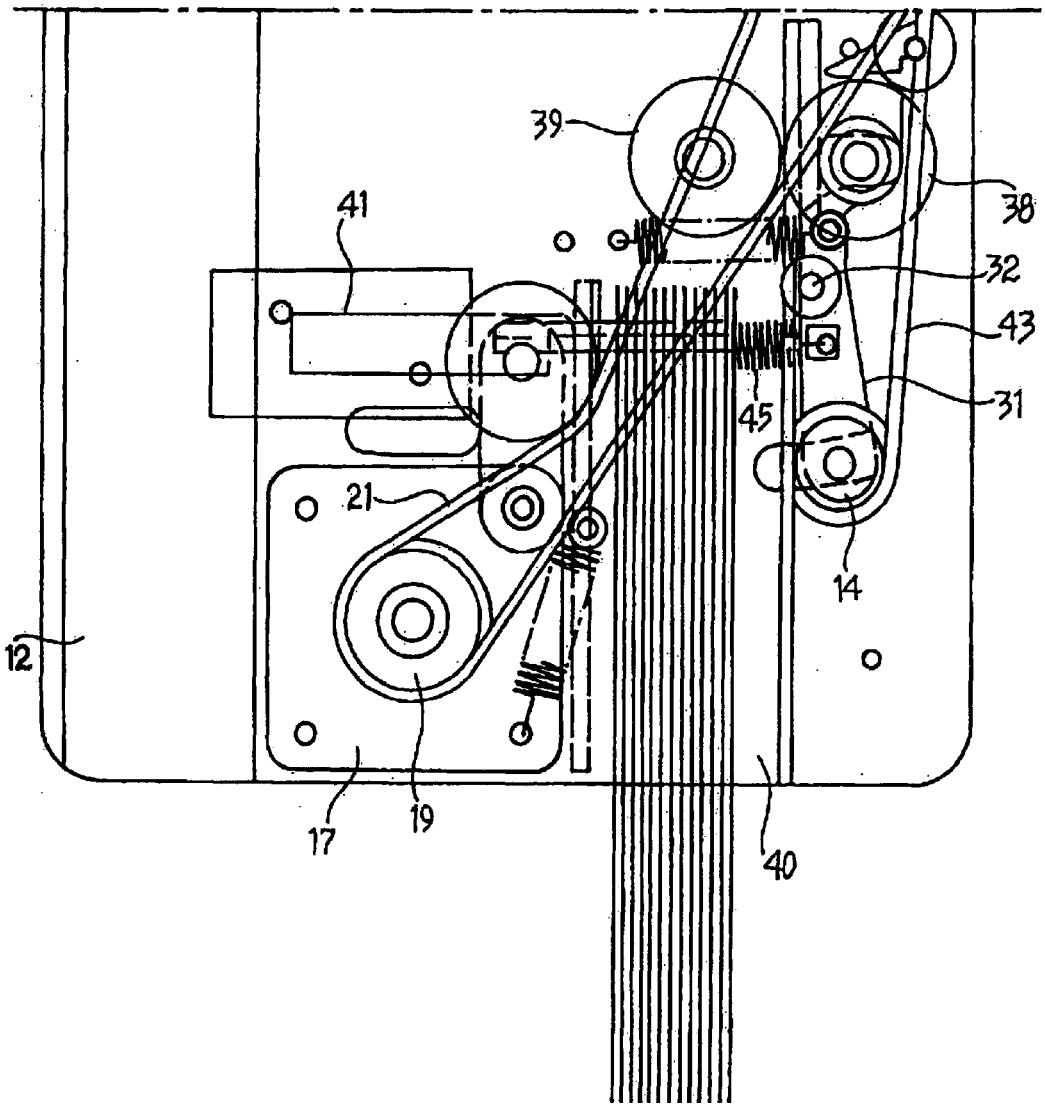
FIG. 5 is a plan view showing the feed device of FIG. 4 on an enlarged scale with a bundle of checks to be scanned.
Figure 6:
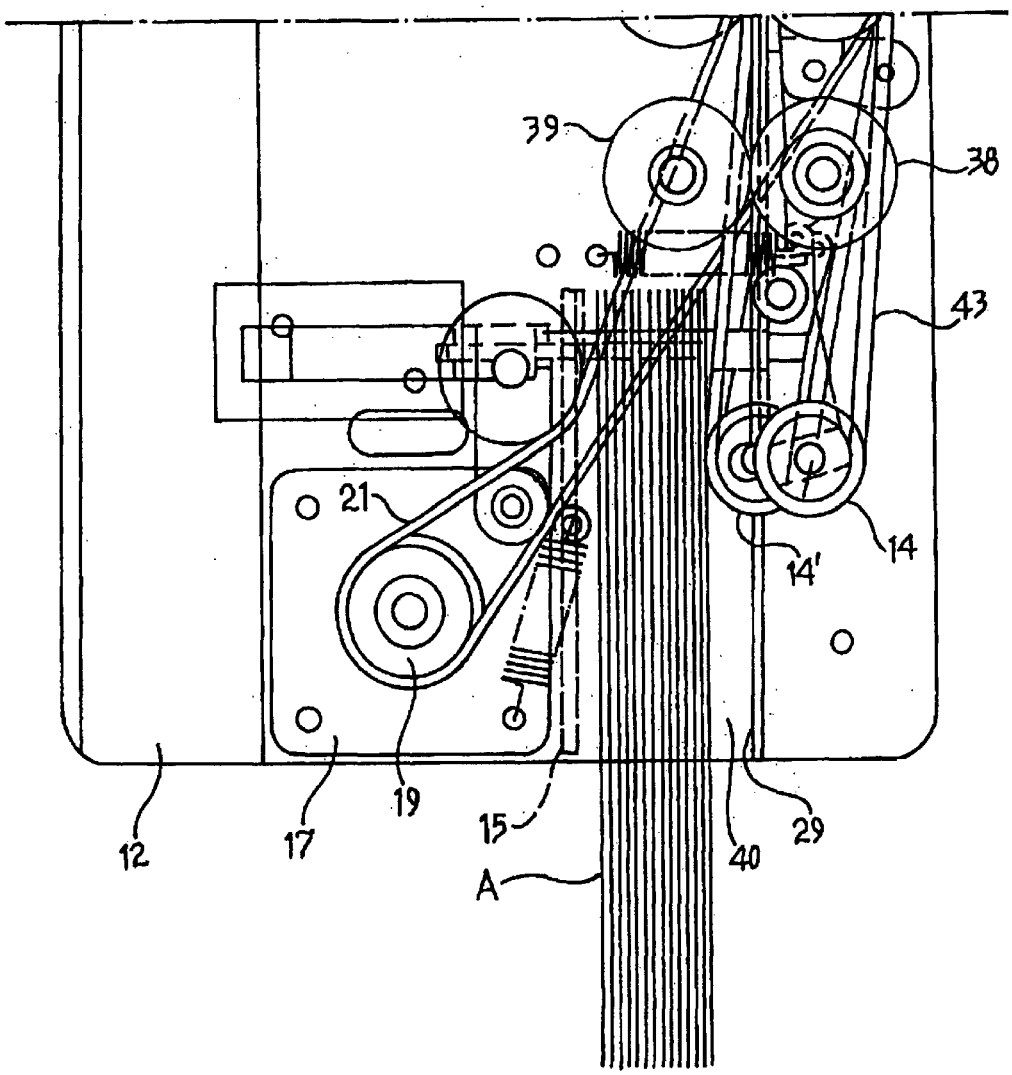
FIG. 6 is a plan view similar to FIG. 5 with the feed device in an operative condition following that shown in FIG. 5.
Figure 7:
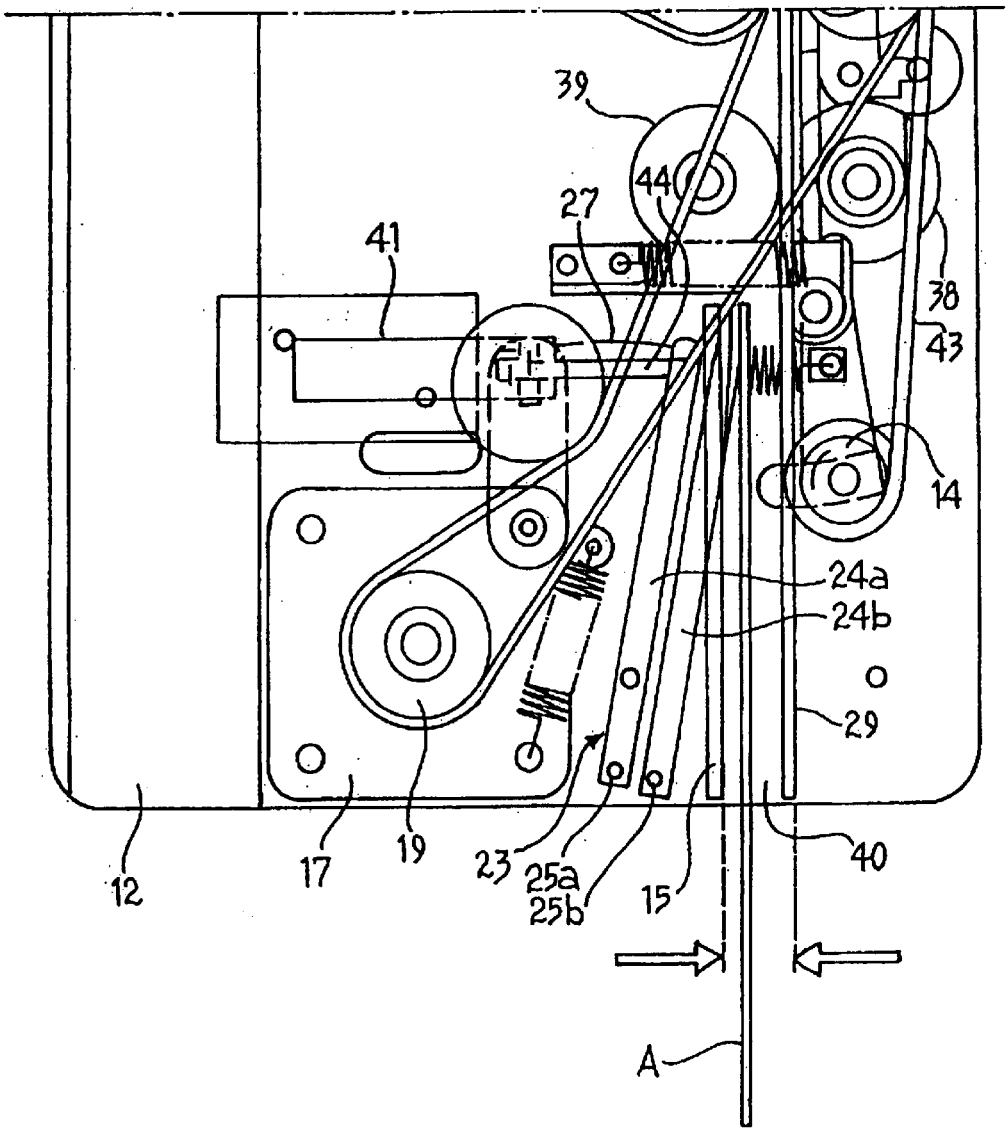
FIG. 7 is a plan view of the feed device of FIGS. 4–6 with a single check to be scanned.
Figure 8:
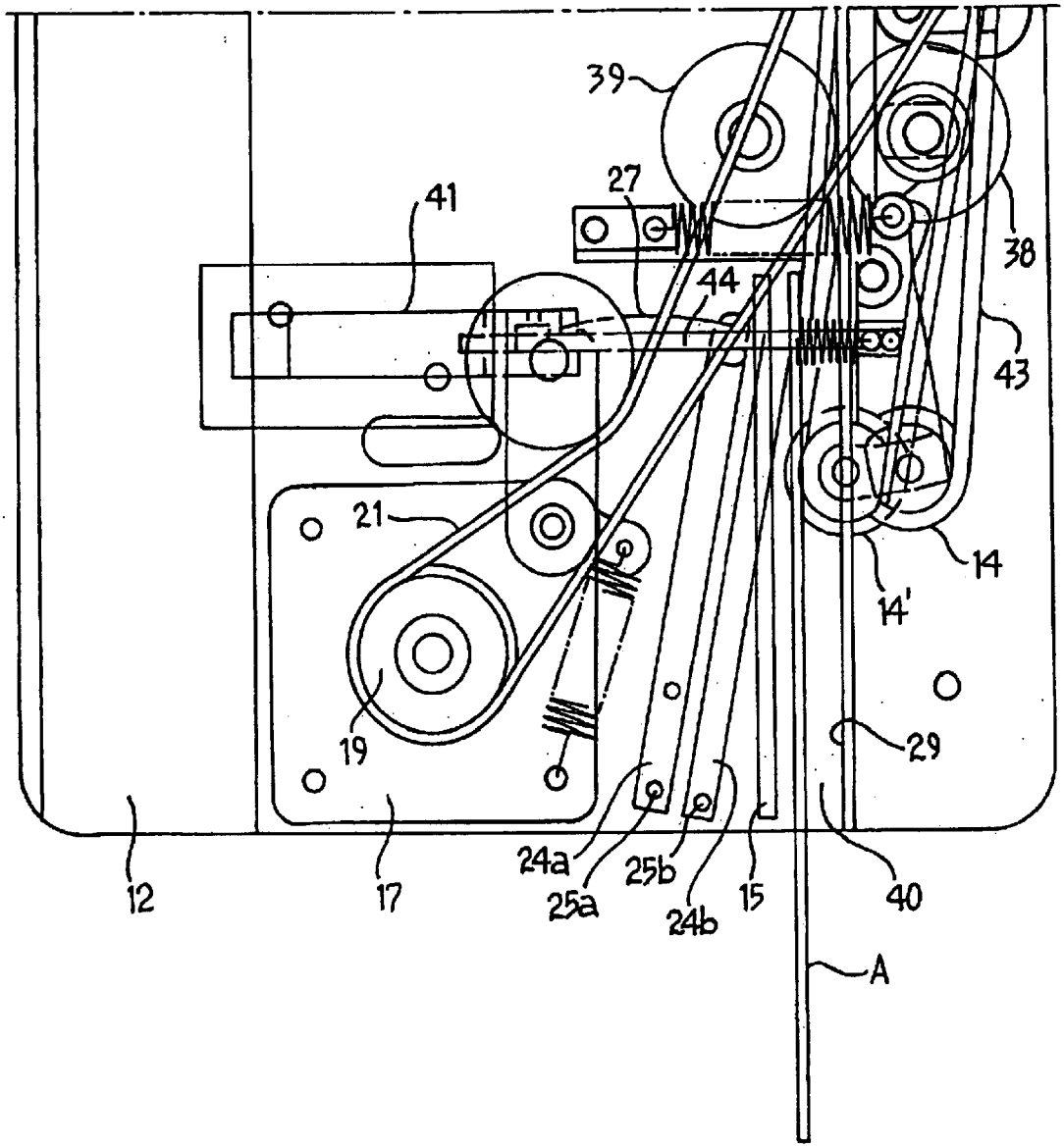
FIG. 8 is a plan view similar to FIG. 7 with the feed device in an operative condition following that shown in FIG. 7.

An important characteristic of the solution according to the present invention is that the feed plate 15 is prevented from coming into abutment with the fixed guide surface 29 so that, when the plate reaches its position closest to the surface 29, there is still a sufficient gap 40 between this surface and the plate 15 for the insertion of at least one check in the input receptacle 11, as shown in FIG. 3. The travel of the plate 15 towards the guide surface 29 is in fact limited by the length of the arcuate slot 27 which has a stop surface 27*a* (FIG. 2; constituted in this embodiment by an end of the slot itself) for the pin 26 which is secured to the plate 15.

The feed device according to the invention operates as follows.

In order to scan a bundle of checks A (FIG. 2), the bundle is inserted in the input receptacle 11 by moving the feed plate 15 manually away from the guide surface 29, against the action of the spring 28. When the plate 15 is released, it urges the checks against the opposing guide surface 29. The photocell 16*a*, 16*b* (FIG. 1), which is obscured by the checks A, activates the first motor 17, by means of an electronic control unit ECU (not shown), in order to pick up a check and the second motor 18 (FIG. 1) in order to move the check through the apparatus. Once the first motor 17 is activated, it sets the motor-driven wheel 19 in rotation, which causes the transmission belt 21 to circulate in the direction indicated by the arrow C in FIG. 2. The transmission belt 21 acts on the roller 14, pulling it into contact with the check disposed adjacent the guide surface 29, causing the lever 31 to pivot in the counterclockwise direction indicated by the double arrow D in FIG. 2. The feed roller 14 moves from the position shown in solid outline in FIG. 1 to the position 14' (FIG. 3) shown in broken outline and, as it rotates, picks up one or more checks from the input receptacle 11 and transfers them towards a pair of motor-driven separator rollers 38, 39. Since the separator roller 39 is contrarotatory relative to the roller 38, it separates the checks, allowing only the check that is disposed farthest to the right (with reference to FIG. 2) to move forwards and pushing the others backwards. The check is then transferred along a predetermined path inside the apparatus, is scanned and, finally, is deposited in an output receptacle 12 by the second feed belt 22 (FIG. 1), in known manner.

The checks of the bundle A that is deposited in the input receptacle 11 are automatically transferred and scanned one at a time sequentially. As the receptacle 11 is gradually emptied, the plate 15 is moved progressively towards the right in order to keep the checks in contact with the wheel 14. When the input receptacle 11 is empty, the motor 17 is stopped and the biasing spring 33 causes the lever 31 to pivot clockwise, moving the roller 14 away from the receptacle 11. The movements of the belt tensioner 34 follow the pivoting movements of the lever 31; naturally, the spring 37 of the belt tensioner 34 is calibrated to compensate for the slackening of the belt caused by the counterclockwise pivoting of the lever 31 but should not appreciably impede its movements.

As will be appreciated, when the feed plate 15 is in its position closest to the surface 29, it is possible to insert a check in the gap 40 without the need to move the plate 15 manually. The scanner apparatus can therefore conveniently be used for the scanning both of individual checks and of bundles of checks.

With reference now to FIG. 3, an operating sequence wholly similar to that described above is also performed when a single check A is deposited in the input receptacle in the gap 40 defined between the guide surface 29 and the plate 15 which is in the position in which it is extended farthest towards the surface 29. It will be noted that the width of the gap 40 actually allows even more than one check to be introduced without the need to move the plate 15 manually, according to the arrangement of the slot 27 relative to the surface 29.

The variant shown in FIGS. 4 to 8 differs from that described above with reference to FIGS. 1 to 3 in that the transmission belt 21 does not engage the feed roller 14 and that the position of this feed roller is controlled by an electromagnetic actuator 41. The belt 21 transmits the rotary movement of the motor-driven roller 19 to a transmission wheel 42. This wheel rotates the feed roller 14 by means of a further transmission belt 43. The activation and deactivation of the motor 17 is accompanied by simultaneous activation and deactivation of the electromagnetic actuator 41 which moves the roller 14 towards and away from the check-input receptacle 11 by means of an extensible rod 44 (FIG. 8) acting on the lever 31 with the interposition of a spring 45.

All of the above U.S. patents, U.S. patent application publications, U.S. patent applications, foreign patents, foreign patent applications and non-patent publications referred to in this specification and/or listed in the Application Data Sheet, are incorporated herein by reference, in their entirety.

The invention is not intended to be limited to the embodiments described and illustrated herein which should be considered as examples of embodiments of the apparatus; rather, the invention may be modified with regard to the form and arrangement of parts and to details of construction and operation.

What is claimed is:

1. A scanner apparatus for scanning bank checks, comprising:

an input receptacle for receiving at least one check to be scanned;

an image-scanner device for scanning at least one of the faces of the check;

an output receptacle for receiving the check after it has been scanned by the scanner device;

a conveyor mechanism for conveying checks, one at a time, from the input receptacle to the output receptacle along a path extending in front of the scanner device;

a feed device for picking up checks from the input receptacle and transferring them to the conveyor mechanism, wherein the feed device includes:

a feed plate movable in the input receptacle and associated with a thrust means for urging the plate resiliently towards an opposed fixed surface, the plate being able to reach a position remote from the surface in order to receive a bundle of checks between the plate and the surface; and a feed roller acting on the side remote from the plate in order to pick up from the input receptacle a check disposed adjacent the surface and to transfer the check towards the interior of the apparatus;

wherein the feed plate is associated with a stop means for stopping the movement of the plate towards the opposed surface in a position close to that surface so as to define between the plate and the surface a gap of sufficient width for the insertion of at least one check in the input receptacle.

2. The scanner apparatus of claim 1 wherein the stop means is formed in a slot in which a pin which is fixed so as to be movable with the feed plate is engaged.

3. The scanner apparatus of claim 2 wherein the stop means is constituted by an end of the slot.

4. The scanner apparatus of claim 1 wherein the feed roller is mounted on a support element mounted movably on the body of the apparatus and associated with means for moving the feed roller and the support element between:

a rest position remote from the feed plate; and an active position near the feed plate, in which the feed roller engages a check in the input receptacle.

5. The scanner apparatus of claim 4 wherein the support element is a lever articulated to the body of the apparatus.

6. The scanner apparatus of claim 4 wherein:

the feed roller is mounted on a support element mounted movably on the body of the apparatus and associated with a biasing spring which tends to bring the roller and the support element to a rest position remote from the feed plate, and wherein:

the feed roller is engaged by a transmission belt driven by a drive roller;

whereby rotation of the drive roller brings about, by means of the belt, rotation of the feed roller and movement of the support element towards the feed plate to an active position in which the feed roller ENGAGES a check in the input receptacle.

7. The scanner apparatus of claim 6 wherein a tensioner device is associated with the transmission belt to compensate for the slackening of the belt resulting from the movement of the support element into the active position.

8. The scanner apparatus of claim 4 wherein the means for moving the feed roller and the support element comprises an electromagnetic actuator.

* * * * *